US005897086A

United States Patent [19]

Condon

[11] Patent Number: 5,897,086

[45] Date of Patent: Apr. 27, 1999

[54] SYSTEM AND METHOD FOR RESTRAINING WATER HEATERS FROM TIPPING OVER DUE TO EARTHQUAKE OR SEVERE WINDS

[75] Inventor: Duane R. Condon, Ramona, Calif.

[73] Assignee: Quick Strap, Inc., San Marcos, Calif.

[21] Appl. No.: 08/912,017

[22] Filed: Aug. 15, 1997

[51] Int. Cl.[6] ..... A47K 1/00

[52] U.S. Cl. ..... 248/220.1; 52/67; 248/154; 248/300

[58] Field of Search ..... 248/313, 300, 248/154, 216.1, 220.1; 410/49; 52/67

[56] References Cited

U.S. PATENT DOCUMENTS

| | | | |
|---|---|---|---|
| 4,020,531 | 5/1977 | Ahrens et al. | 24/284 |
| 4,783,030 | 11/1988 | Buerhop | 248/744 |
| 4,955,573 | 9/1990 | Horvath | 248/313 |
| 4,958,814 | 9/1990 | Johnson | 248/216.1 X |
| 5,020,760 | 6/1991 | Mayr | 248/313 |
| 5,085,387 | 2/1992 | Peterson et al. | 248/154 |
| 5,131,133 | 7/1992 | Peterson et al. | 29/525.1 |
| 5,190,260 | 3/1993 | Daubenspeck | 248/313 |
| 5,393,024 | 2/1995 | Daubenspeck | 248/313 |
| 5,487,518 | 1/1996 | McCraney et al. | 248/225.11 |
| 5,746,405 | 5/1998 | Dvorak et al. | 248/154 X |

OTHER PUBLICATIONS

Quick Strap 50 by HoldRite, two pages of installation instructions (undated).

Spacemaker TS–E–25, 2 pages of installation instructions (undated).

*Primary Examiner*—Ramon O. Ramirez

*Attorney, Agent, or Firm*—Knobbe, Martens, Olson & Bear, LLP

[57] ABSTRACT

Upper and lower pairs of horizontally spaced L-shaped brackets made of steel are secured via fasteners to the rear sides of spaced apart vertical studs during the framing stage of building construction. During subsequent drywall installation the pointed ends of the perpendicularly extending strap attachment portions of each bracket penetrate the drywall and project outwardly from the studs and drywall. Upper and lower sheet metal straps, each having a sequence of equally spaced holes, are cut to length so that they can partially encircle the upper and lower third of a water heater. The terminal ends of the straps are connected to corresponding ones of the strap attachment portions of the brackets and placed under tension with bolt assemblies.

50 Claims, 2 Drawing Sheets

SYSTEM AND METHOD FOR RESTRAINING WATER HEATERS FROM TIPPING OVER DUE TO EARTHQUAKE OR SEVERE WINDS

BACKGROUND OF THE INVENTION

The present invention relates to plumbing in general, and more particularly, to devices used to restrain residential water heaters.

States which have a high earthquake risk require that residential water heaters be secured so that they will not tip over as a result of seismic disturbances. This prevents serious injury that a person might incur if hit by a heavy water heater falling off a raised platform. Also, if the water heater tips over, the gas line will rupture, creating a severe danger of fire and/or explosion. Hawaii has a similar requirement to secure water heaters from tipping over due to high winds.

For example, by law in California (Section 19211(a) of the Health and Safety Code) all new and replacement water heaters sold in California on or after Jul. 1, 1991, and all existing water heaters shall be braced, anchored, or strapped to resist falling or horizontal displacement due to motion induced by earthquake.

Section 510.5(e) of the Uniform Plumbing Code (UPC) requires that in seismic zones three and four, water heaters shall be anchored or strapped to resist horizontal displacement due to earthquake motion. According to this section, strapping shall be at points within the upper one-third and lower one-third of its vertical dimensions, and a minimum of four inches above the controls shall be maintained relative to the lower strapping.

Even before laws were enacted that mandate the anchoring of water heaters, plumbers tape has been wrapped around the top third and bottom third of a residential water heaters. The tape is then nailed to the wall studs. The studs are difficult to locate and the tensile strength of such attachments is dubious, at best.

Various products have been specially developed and commercialized for more securely anchoring residential water heaters. The QUICK STRAP 50 (Trademark) water heater restraint manufactured by HoldRite, Inc. of San Marcos, Calif. comprises upper and lower metal straps that surround the water heater. Each strap has its opposite ends connected via lag bolts through dry wall into adjacent wall studs. Each strap has two segments which have vertical slots into which are fitted U-shaped metal brackets. The brackets are pulled together by a nut and bolt assembly. The packaging for this product indicates "patent pending". A similar product with straps and tensioning buckles is sold under the trademark SPACEMAKER TS-E-25.

While the aforementioned commercial products may appear to provide some degree of restraint, they are often improperly installed and do not achieve their ultimate goal. Both products are installed after the drywall has been hung. Therefore, it is difficult to accurately locate the studs. Tapping the wall for sound or using a stud finder is tedious and prone to error. Frequently, the installer does not locate the center of the stud and/or drills the wrong size pilot hole. The lag bolt screwed into the pilot hole may thus not provide the desired tensile strength. Worse yet, a building inspector cannot check for correct anchoring with these devices. Frequently, the installer drills a number of test holes, requiring subsequent spackling and painting. In addition, both the aforementioned commercial products include up to sixteen feet of strap to accommodate various mounting configurations, and much of this strap ends up being wasted.

SUMMARY OF THE INVENTION

It is, therefore, the primary object of the present invention to provide an improved system for restraining a water heater to prevent the same from tipping over due to earthquake or wind induced motion.

It is another object of the present invention to provide an improved method for restraining a water heater to prevent the same from tipping over due to earthquake or wind induced motion.

It is another object of the present invention to make it easier for plumbers to comply with building codes that require the anchoring of water heaters.

It is another object of the present invention to reduce the amount of labor and materials required to properly restrain a residential water heater.

It is another object of the present invention to ensure that water heater restraints have the proper tensile strength.

According to the present invention, a system is provided for restraining a water heater to prevent the same from tipping over. The system includes upper and lower pairs of horizontally spaced brackets. The first bracket of each pair is secured to a rear side of a first wall stud. The second bracket of each pair is secured to a rear side of an adjacent second wall stud. The system further includes upper and lower straps for partially encircling a water heater. Connecting mechanisms, such as nut and bolt assemblies, are used to secure the ends of each strap to a corresponding bracket.

The method of the present invention includes the following steps. During a framing stage of construction and prior to the installation of drywall, an upper pair of horizontally spaced brackets and a lower pair of horizontally spaced brackets are installed at the proper heights on a plurality of studs adjacent a location where a water heater is to be anchored. Each bracket is secured to a corresponding one of the studs with at least one fastener. A strap attachment portion of each bracket extends in an outward direction from the stud. Next, drywall is installed over the plurality of studs in a manner that allows the strap attachment portion of each of the brackets to penetrate through the drywall. The water heater is then vertically positioned at the location between the brackets of the upper and lower pairs of brackets. An upper strap and a lower strap are cut so that each strap has a dimension that allows it to partially encircle the water heater while a pair of its terminal ends can reach the strap attachment portions of the corresponding brackets. Finally, the terminal ends of the upper strap are secured to the corresponding strap attachment portions of the upper brackets and the terminal ends of the lower strap are secured to the corresponding strap attachment portions of the lower brackets.

DETAILED DESCRIPTION OF THE PREFERRED EMBODIMENTS

Figure 1:
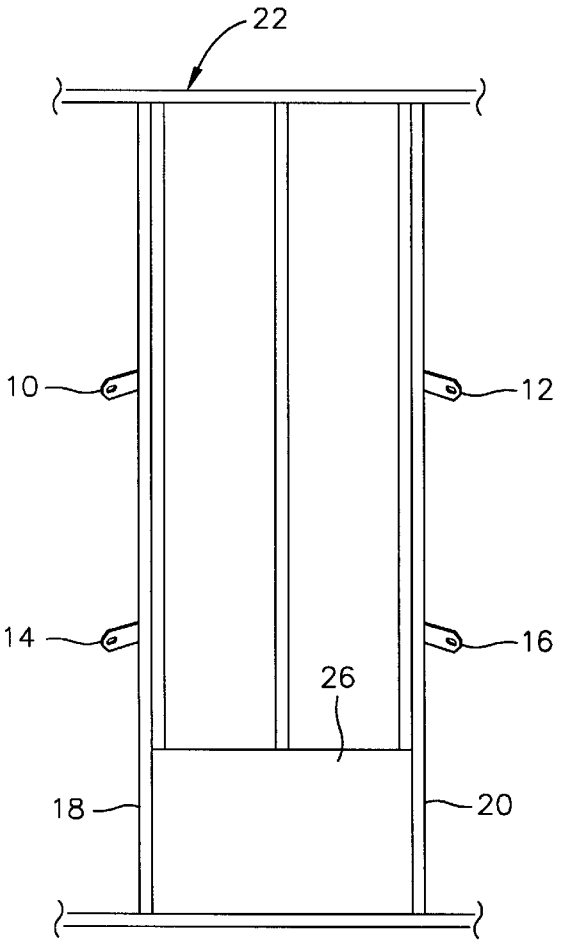
FIG. 1 is a diagrammatic elevation view of a stud wall with an adjacent stand for supporting a residential water heater, before the installation of drywall. In this view, so that they are visible, the attachment brackets are shown bent outwardly from the studs, which is not their true configuration.
Figure 2:
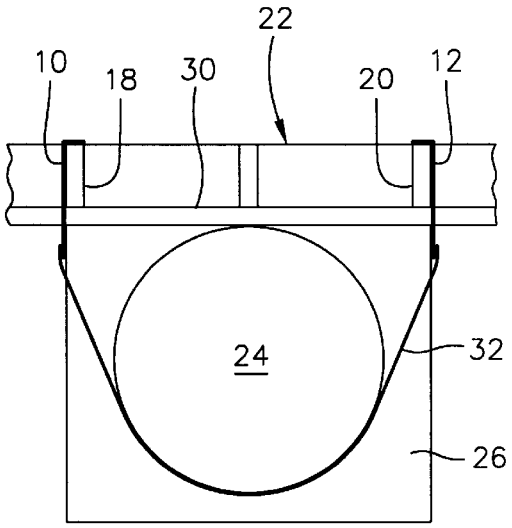
FIG. 2 is a diagrammatic horizontal sectional view of the stud wall of FIG. 1 after the installation of drywall showing the water heater anchored to the wall on top of the stand utilizing the system of the present invention.

Referring to FIGS. 1 and 2, during a framing stage of construction, and prior to the installation of drywall, an upper pair of horizontally spaced brackets 10 and 12 and a lower pair of horizontally spaced brackets 14 and 16 are installed on a plurality of vertical studs 18 and 20 in a stud wall 22 adjacent a location where a water heater 24 is to be anchored. The height of the brackets is selected so that the straps connected thereto will engage the top third and bottom third water of the water heater, as prescribed by the applicable plumbing code. The water heater 24 is a generally cylindrical upright container of the type normally used in residences. It may be gas or electric powered and typically has a capacity of fifty gallons. The location is usually on top of a stand 26 that elevates the water heater off the floor as prescribed by the applicable plumbing code.

Figure 3:
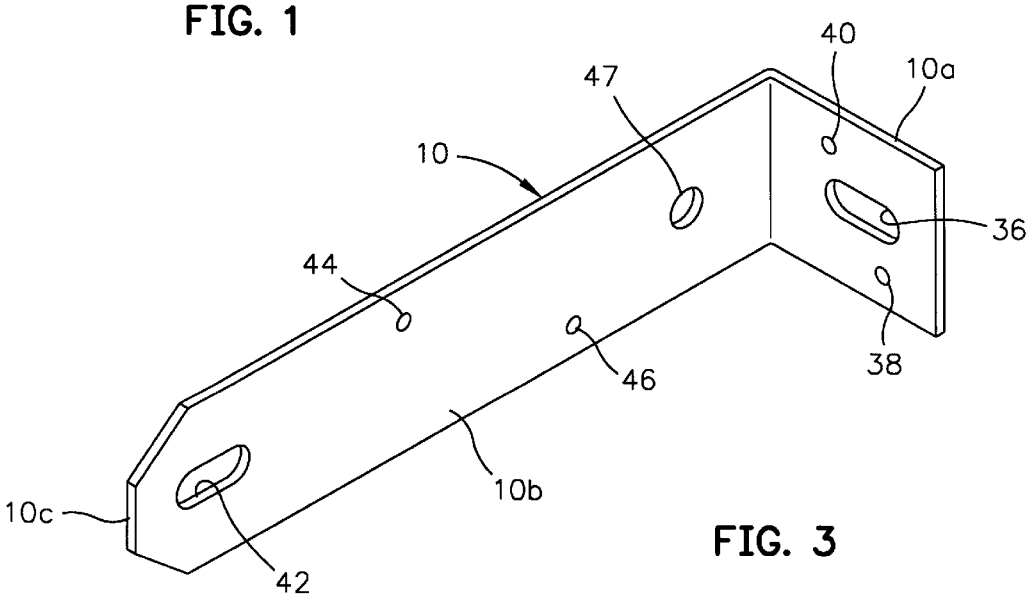
FIG. 3 is an isometric view of one of the brackets of the system of the present invention.
Figure 4:
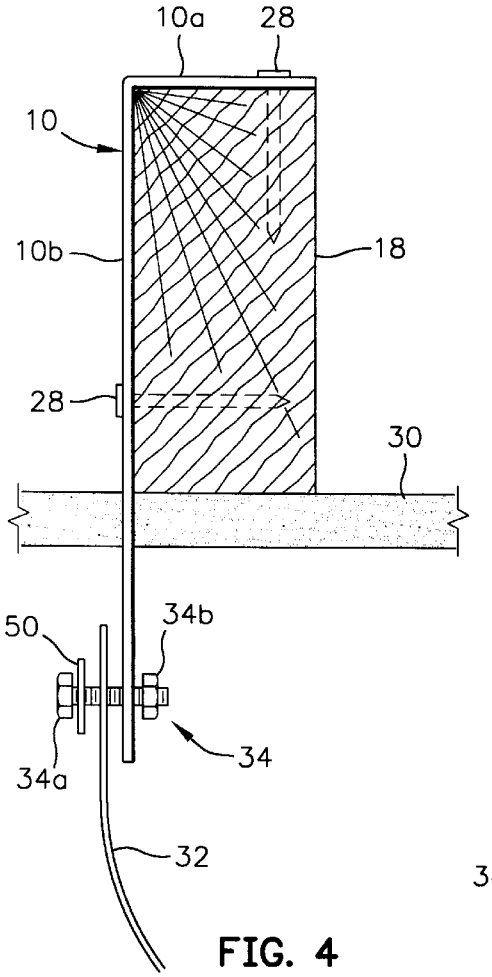
FIG. 4 is a greatly enlarged horizontal sectional view showing details of the mounting of a bracket to a stud and the connection of a strap thereto in accordance with the system and method of the present invention.

Each of the brackets 10, 12, 14 and 16 has an identical configuration, and its manner of attachment to its associated stud is identical to the way the other brackets are attached to their corresponding studs. Therefore, only the configuration of bracket 10 and its manner of attachment to the stud 18 need be described in detail. The bracket 10 (FIG. 3) has a generally L-shaped configuration that includes a inner first leg 10*a* that is secured to the rear side of the stud 18 as illustrated in FIG. 4. The leg 10*a* is preferably secured to the stud 18 with at least one fastener, such as a sixteen penny nail 28 (FIG. 4). The bracket 10 further has a second leg 10*b* that forms a strap attachment portion. The strap attachment portion 10*b* (FIG. 3) extends perpendicularly in an outward direction from the stud 18.

Conventional drywall 30 (FIG. 4) is installed over the plurality of studs in a manner that allows the strap attachment portion 10*b* of the bracket 10 to penetrate through the drywall 30. The strap attachment portion 10*b* has an outer end 10*c* (FIG. 3) with a tapered shape that facilitates penetration through a sheet of drywall manually forced against the same by an installer, much like a knife blade penetrating through a cardboard sheet. During taping and mudding, the areas around the base of each strap attachment portion can be finished off for aesthetic reasons, prior to painting.

Next the water heater 24 (FIG. 2) is vertically positioned at the installation location on top of the stand 26 between the upper brackets 10 and 12 and lower brackets 14 and 16. An upper strap 32 (FIG. 2) and a lower strap (not illustrated) are cut so that each strap has a length or dimension that allows it to partially encircle the water heater 24. At the same time, the upper and lower straps are cut to length so that a pair of terminal ends of each strap can reach the strap attachment portions of the corresponding brackets. Finally, one terminal end of the upper strap 32 is secured to the strap attachment portion 10*b* of the upper bracket 10 via nut and bolt assembly 34 (FIG. 4). The other terminal end of the upper strap 32 is similarly secured to the strap attachment portion of the upper bracket 12. The lower strap (not illustrated) is similarly connected to the lower brackets 14 and 16.

The bracket 10 (FIG. 3) is preferably made of a unitary piece of sheet metal such as fourteen gauge steel. The inner first leg 10*a* has a length which is substantially the same as the thickness (smaller dimension) of the stud 18. This facilitates attachment of the first leg 10*a* to the rear side of the stud 18. The second leg 10*b* of the bracket 10 has a length substantially greater than the width (large dimension) of the stud 18. This allows the second leg 10*b* to extend across the stud in an outward direction and through the drywall 30 to form a projecting strap attachment portion, as best seen in FIG. 4. The inner first leg 10*a* has a first elongated aperture 36 (FIG. 3) and a first plurality of round fastener holes 38 and 40 formed therein. The second leg or strap attachment portion 10*b* has a second elongated aperture 42, a second plurality of round fastener holes 44 and 46, and a larger round hole 47 formed therein. The elongated apertures 36 and 42 each have a diameter suitable for having the bolt 34*a* of an assembly 34 (FIG. 4) inserted therethrough. The reason for the elongation of the apertures 36 and 42 will be explained hereafter. Suitable fasteners such as nails or screws of the proper size and length may be hammered or screwed into the fastener holes. Two sixteen penny nails 28 driven through the holes 38 and 44 into two adjacent sides of the stud 18 has proven more than sufficient to securely anchor the bracket to the stud wall 22.

Figure 5:
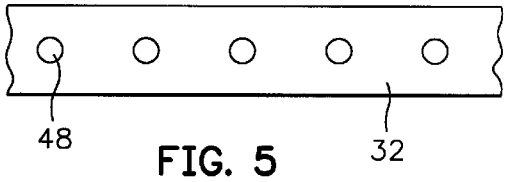
FIG. 5 is a plan view of a segment of one of the straps of the system of the present invention.

Both the upper and lower straps are identical so only the upper strap 32 need be described. FIG. 5 is a plan view of a segment of the strap 32. As previously mentioned, it is dimensioned for partially encircling the water heater 24 as shown in FIG. 2. The strap 32 is preferably made of sheet metal such as twenty-two gauge steel. It has a plurality of equally spaced identical holes 48 punched along the length thereof with a diameter suitable for having the bolt 34*a* of an assembly 34 (FIG. 4) inserted therethrough.

Each nut and bolt assembly 34 (FIG. 4) provides a means for connecting a terminal end of a corresponding strap to a bracket. More particularly, as illustrated in FIG. 4, the threaded shank of the bolt 34*a* extends through the elongated aperture 42 of the strap attachment portion 10*b* of the bracket 10, and through the final or last hole 48 at one end of the strap 32. A washer 50 is positioned between the head of the bolt 34*a* aid the strap 32. A nut 34*b* is screwed over the threaded shank of the bolt 34*a* down tight against the strap attachment portion 10*b* of the bracket 10.

Figure 6:
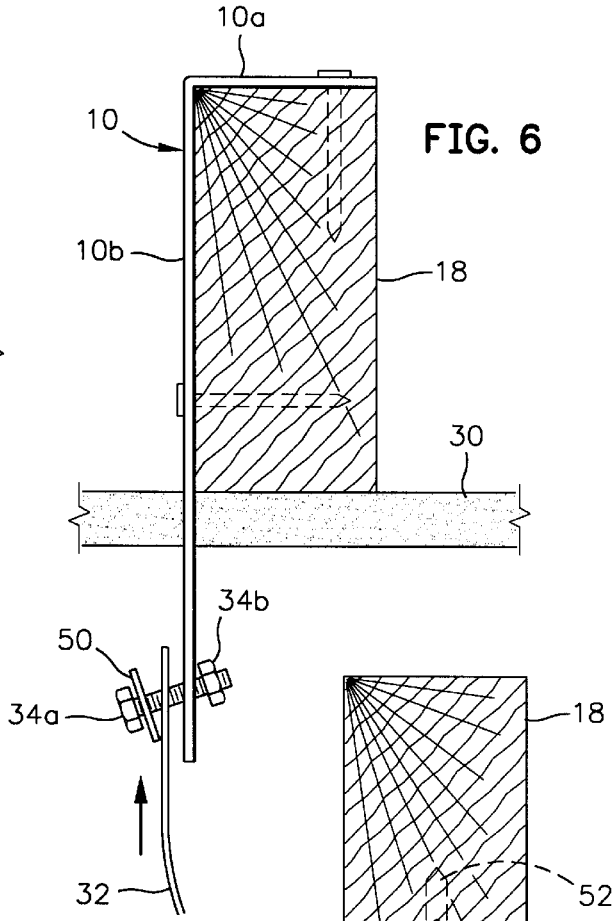
FIG. 6 is a greatly enlarged horizontal sectional view illustrating the manner in which a bolt assembly initially connects a strap attachment portion of a bracket to a terminal end of a strap so that it may be subsequently tightened to put tension on the strap.

FIG. 6 is a sectional view illustrating the manner in which the bolt assembly 34 initially connects the strap attachment portion 10*b* of the bracket 10 to the terminal end of the strap 32. When installing the system of the present invention, the plumber measures the distance between the brackets 10 and 12, for example from the hole 42 in one bracket to the hole 42 in the other bracket. The plumber then cuts a piece of strap 32 slightly less (to the nearest hole 48) than the measurement that was taken. Two bolt assemblies 34 are then used to connect the terminal ends of the strap 32 (through the final hole in each end of the strap) to the strap attachment portions of the brackets. The strap is slightly shorter than the measured distance and the holes 42 in the two brackets are elongated to allow for variations in tolerances. Because of this, each bolt 34*a* initially extends at an angle as illustrated in FIG. 6. Thereafter, each nut 34*b* may be tightened to put tension on the strap 32 and pull it snug against the periphery of the water heater 24. The direction of pulling is indicated by the arrow in FIG. 6.

FIG. 2 shows that there is no space between the strap 32 and the water heater 24 after tightening the strap 32. Zero clearance water heaters should press against the drywall 30 when the upper and lower straps are tensioned. Other water heaters should have extra blocks of drywall or other suitable non-combustible spacers (not illustrated) between the water heater 24 and the drywall 30 overlying the stud wall 22.

Rigorous tests of a prototype of the system described above were conducted by an independent testing agency approved by the State Architect of the State of California. It was found to far exceed the safety requirements imposed by the above referenced California Health and Safety Code section, thereby legally entitling it to be called an "ACCEPTABLE METHOD" for anchoring water heaters in the State of California. Unlike the prior art approaches described in the background above, the strength of the attachment between the straps of my invention and the studs does not rely on the tensile strength or pull out force of a lag bolt. With the prior art approaches, if a pilot hole is drilled too large or if the studs are partially missed, the lag bolt may not have the required degree of tensile strength.

With my invention, a kit can be supplied to the builder consisting of a single roll of strap 32 along with numerous brackets 10 and 12 and nut and bolt assemblies 34. The upper and lower strap segments can be cut to length from the roll, with no waste. Prior art designs, such as the SPACE-MAKER TS-E-25 and the HoldRite products described above, require extra length straps in order to accommodate any size and installation demands. This is partly necessitated due to their utilization of buckle-type strap segment connectors. With the aforementioned commercial products significant strap is cut away and discarded and ends up rusting in landfills.

Figure 7:
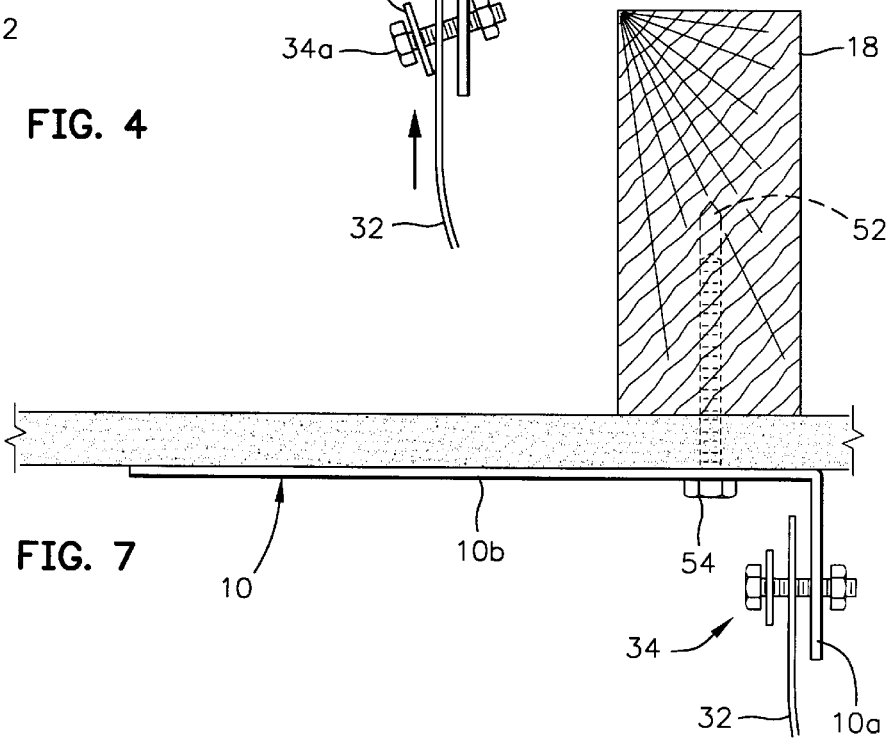
FIG. 7 is a greatly enlarged horizontal sectional view illustrating an alternate configuration for attaching the bracket of FIG. 3 after installation of the drywall.

In some cases the builder may forget to instruct the plumber to install the brackets 10, 12, 14 and 16 during the framing stage. FIG. 7 is a diagrammatic view illustrating an alternate configuration for attaching the bracket of FIG. 3 after installation of the drywall. Once the drywall 30 has been installed, the brackets can still be installed in a different configuration over the drywall. However, this method suffers from the same drawbacks attributable to difficulty in locating the studs as described in the background above. Nevertheless, the installation configuration shown in FIG. 7 illustrates the versatility of my invention. Again, only the installation and connection of the bracket 10 need be described since the same discussion applies to the brackets 12, 14 and 16. The second leg 10*b* of the bracket is placed over the drywall 30. After a pilot hole 52 has been drilled into the stud 18, a lag bolt 54 is inserted through the larger round hole 47 (FIG. 3) in the second leg 10*b* and is tightened into the pilot hole. Referring again to FIG. 7, the bolt of the assembly 34 is then used to connect the end of the strap 32 to the inner first leg 10*a* of the bracket 10 using the elongate hole 36 (FIG. 3) in the first leg 10*a* of the bracket. The nut of the assembly 34 is then tightened to cinch up the strap 32 as explained in connection with FIG. 6.

Having described preferred embodiments of my system and method for restraining water heaters from tipping over due to earthquake or wind induced motion, it should be apparent to those skilled in the art that my invention may be modified in both arrangement and detail. For example, where codes permit the same, only one set of brackets and one strap need be utilized. The stud wall could form a corner or a U-shaped pocket and the straps could then be even shorter. The first leg 10*a* could be eliminated. Also, my invention could be implemented with any fixture or anchoring device attached to the framing members before the installation of any type of wall covering. Therefore the protection afforded my invention should only be limited in accordance with the scope of the following claims.

I claim:

1. A system for restraining a water heater to prevent the same from tipping over, comprising:

a first bracket;

means for securing the first bracket to a rear side of a first wall stud;

a second bracket;

means for securing the second bracket to a rear side of a second wall stud;

a strap dimensioned for partially encircling a water heater;

first means for connecting a first end of the strap to the first bracket; and second means for connecting a second end of the strap to the second bracket.

2. The system of claim 1 wherein the first and second brackets each comprise a generally L-shaped unitary piece of metal having a first leg for attachment to the rear side of a corresponding one of the first and second studs and a second leg for attachment to a corresponding one of the first and second connecting means.

3. The system of claim 2 wherein the second leg of each bracket has an aperture formed therein.

4. The system of claim 3 wherein the first leg of each of the first and second brackets has a plurality of fastener holes formed therein.

5. The system of claim 4, wherein the strap has at least one hole and wherein the first and second connecting means each comprises a bolt and nut assembly for extending through the aperture of the second leg of a corresponding one of the first and second brackets and a corresponding hole in the strap.

6. The system of claim 5, wherein the aperture in the second leg of each of the first and second brackets has an elongated shape and the strap is dimensioned so that the bolts of each assembly can be inserted in a hole in a corresponding end of the strap and the strap will tighten around the water heater when each nut is tightened over its corresponding bolt.

7. The system of claim 3 wherein the second leg of each of the first and second brackets has a plurality of fastener holes formed therein.

8. The system of claim 1 wherein the first leg of each bracket has an aperture formed therein.

9. The system of claim 1 wherein an outer end of the second leg of each of the brackets is shaped to facilitate penetration through drywall.

10. The system of claim 1 and further comprising a plurality of fasteners for securing the first and second brackets to the first and second studs, respectively.

11. A method for restraining a water heater to prevent the same from tipping over, comprising the steps of:

during a flaming stage of construction, and prior to the installation of drywall, installing an upper pair of horizontally spaced brackets and a lower pair of horizontally spaced brackets on a plurality of studs adjacent a location where a water heater is to be anchored, each bracket being secured to a corresponding one of the studs with at least one fastener and having a strap attachment portion that extends in an outward direction from the corresponding stud;

installing drywall over the plurality of studs and allowing the strap attachment portion of each of the brackets to penetrate through the drywall;

vertically positioning the water heater at the location between the brackets of the upper and lower pairs of brackets;

providing an upper strap and a lower strap, each strap being dimensioned to partially encircle the water heater and having a pair of terminal ends that reach the strap attachment portions of the brackets of a corresponding pair of the upper and lower brackets;

securing the terminal ends of the upper strap to the corresponding strap attachment portions of the upper brackets; and securing the terminal ends of the lower strap to the corresponding strap attachment portions of the lower brackets.

12. The method of claim 11 wherein the securing step is accomplished by connecting each terminal strap end and corresponding bracket with a bolt and nut assembly so that when the all of the nuts of each assembly are screwed over their corresponding bolts, the straps are tightened around the water heater.

13. The method of claim 12 wherein the securing step presses the water heater against the drywall.

14. The method of claim 12 wherein each nut and bolt assembly includes a washer between the nut and the corresponding strap end.

15. The method of claim 11 wherein each bracket has an inner leg which is connected to the strap attachment portion, the inner leg extending across a rear side of its corresponding stud.

16. The method of claim 11 wherein each bracket has a generally L-shaped configuration including an inner leg which is connected to the strap attachment portion.

17. The method of claim 11 wherein the strap attachment portion of each bracket has an elongated aperture for receiving a bolt therethrough for connection to a corresponding terminal end of a corresponding one of the straps.

18. The method of claim 11 wherein the brackets are nailed to their corresponding studs.

19. The method of claim 11 wherein the upper and lower straps partially encircle the water heater at substantially one third a distance from a top thereof, and at substantially one third a distance from a bottom thereof, respectively.

20. A water heater installation, comprising:

a wall including a plurality of framing members;

a layer of wall covering overlying the framing members;

first and second upper anchoring devices secured to corresponding ones of the framing members prior to the installation of the layer of wall covering, the first and second anchoring devices each including a strap attachment portion projecting outwardly through the wall covering;

third and fourth lower anchoring devices secured to corresponding ones of the framing members prior to the installation of the layer of wall covering, the third and fourth anchoring devices each including a strap attachment portion projecting outwardly through the wall covering;

a water heater positioned adjacent the stud wall between the first and second anchoring devices and between the third and fourth anchoring devices;

an upper strap dimensioned for partially encircling the water heater;

first means for connecting a first end of the upper strap to the first anchoring device;

second means for connecting a second end of the upper strap to the second anchoring device;

a lower strap dimensioned for partially encircling the water heater;

third means for connecting a first end of the lower strap to the third anchoring device;

fourth means for connecting a second end of the lower strap to the fourth anchoring device.

21. The water heater installation of claim 20 wherein each bracket extends around and is secured to a rear side of a corresponding stud.

22. The water heater installation of claim 21 wherein each bracket is generally L-shaped.

23. A system for restraining a water heater to prevent the same from tipping over, comprising:

a generally L-shaped first bracket made of a unitary piece of metal and having a first leg for attachment to the rear side of a first adjacent stud and a second leg extending in an outward direction from the first stud, the first leg having a first aperture and at least one fastener hole formed therein, and the second leg having at least one fastener hole and a second aperture formed therein;

a first plurality of fasteners extending through the fastener holes of the first bracket and securing the first bracket to the rear side of the first stud;

a generally L-shaped second bracket made of a unitary piece of metal and having a first leg for attachment to the rear side of a second adjacent stud and a second leg extending in an outward direction from the second stud, the first leg having a third aperture and at least one fastener hole formed therein, and the second leg having at least one fastener hole and a fourth aperture formed therein;

a second plurality of fasteners extending through the fastener holes of the second bracket and securing the second bracket to the rear side of the second stud;

an outer end of the second leg of each of the brackets being shaped to facilitate penetration through drywall;

a strap dimensioned for partially encircling a water heater and having a plurality of equally spaced holes formed along a length thereof;

first means for connecting a first end of the strap to the first bracket including a first bolt and nut assembly for extending through the second aperture of the second leg of the first bracket and a corresponding hole in the first end of the strap; and second means for connecting a second end of the strap to the second bracket including a second bolt and nut assembly for extending through the fourth aperture of the second leg of the second bracket and a corresponding hole in the second end of the strap; and wherein the second and fourth apertures in the second legs of the first and second brackets, respectively, have an elongated shape and the strap is dimensioned so that the bolts of each assembly can be inserted in a final hole in a corresponding end of the strap and the strap will tighten around the water heater when each nut is tightened over its corresponding bolt.

24. A system for restraining a water heater by a strap connected to at least one of a first or second wall framing members, the members having a side surface joining front and rear opposing surfaces, with the front surface nearer the water heater than a rear surface, comprising: a first bracket having a first leg adapted to engage the rear surface, a second leg connected to the first leg and sized and configured to extend along and beyond the side surface, the second leg having a distal end configured to connect to the strap when the system is in use.

25. A system as defined in claim 24, wherein the second leg has a distal end that is tapered in a manner that facilitates penetration of the second leg through a sheet of drywall.

26. A system as defined in claim 24, further comprising at least one hole in the first and second legs sized to allow passage of a fastener to fasten the legs to the rear and side surfaces.

27. A system as defined in claim 24, further comprising fasteners fastening at least one of the legs to at least one of the respective side and rear surfaces of the framing member.

28. A system as defined in claim 27, wherein the strap is connected to the second leg.

29. A system as defined in claim 28, wherein the first bracket is connected to the first member, and further comprising a second bracket having a third leg adapted to engage the rear surface of the second framing member and a fourth leg connected to the third leg and configured to extend along and beyond the side surface of the second framing member, the fourth leg being connected to the strap to support the water heater when the system is in use.

30. A system as defined in claim 29, wherein the second leg of at least one of the first or second brackets has a distal end that is tapered in a direction that facilitates penetration of the second leg through a sheet of drywall.

31. A system as defined in claim 30, further comprising a third bracket having a fifth leg adapted to engage the rear surface of the second framing member below the first leg, a sixth leg connected to the fifth leg and configured to extend along and beyond the side surface of the first framing member, the sixth leg being connected to a second strap to support the water heater when the system is in use, and a fourth bracket having a seventh leg adapted to engage the rear surface of the second framing member below the third, leg and an eighth leg connected to the seventh leg and configured to extend along and beyond the side surface of the second framing member, the eighth leg being connected to the second strap to support the water heater when the system is in use.

32. A system as defined in claim 31, further comprising a layer of drywall interposed between at least one of the second, fourth, sixth and eighth legs and the connection with the strap associated with that at least one leg.

33. A system as defined in claim 32, wherein the at least one leg further has a distal end that is tapered to facilitate penetration of that leg through the sheet of drywall.

34. A bracket for connecting to a strap used to secure a water heater to a stud in a wall, the stud having opposing front and rear surfaces with a thickness and separated by a side having a width, comprising a metal, L-shaped bracket having a short leg configured to abut the width of the stud, the short leg having at least one hole therein through which a fastener can extend to fasten the short leg to the stud when in use, the bracket having a long leg longer than the width of the stud, the long leg having at least one hole therein through which a fastener can extend to fasten the long leg to the stud when in use, the long leg having a free end configured to fasten to the strap.

35. The system as defined in claim 34, wherein the free end of the long leg is tapered in a way that facilitates penetration of that leg through a wall covering.

36. A system for restraining a water heater, comprising a first bracket having a first leg connected to the rear side of a first wall support member and having a second leg extending along a side of the member and having a distal end connected to a strap that encircles at least a portion of a water heater, and a second bracket having a first leg connected to the rear side of a second wall support member and having a second leg extending along a side of the second member and having a distal end connected to the strap.

37. The system of claim 36, further comprising drywall interposed between the water heater and the wall support, the second legs of the brackets extending through the drywall and being connected to a strap located and sized to at least partially encircle a water heater to restrain the heater.

38. A combination, comprising:

a first bracket having a first leg configured to be connected to the rear side of a first stud in a wall, the bracket having a second leg configured to extending along and beyond a side of the first stud and having a distal end;

a second bracket having a first leg configured to be connected to the rear side of a second stud in a wall, the second bracket having a second leg configured to extending along and beyond a side of the second stud and having a distal end;

a strap of sufficient length and strength to encircle and support at least a portion of a water heater interposed between the brackets, during an earthquake, the strap having an end configured to fasten to the distal end of one of the brackets.

39. The combination of claim 38, wherein the brackets are formed of metal strips that have distal ends tapered toward a point.

40. A method for restraining a water heater by encircling at least a portion of the water heater with a strap that is connected to at least one stud in a wall to prevent the water heater from tipping over during an earthquake, the stud having opposing front and rear surfaces with a thickness and separated by a side having a width, comprising the steps of securing a first bracket to the stud so the bracket abuts a rear side of a wall stud near a location where the water heater is to be anchored, and extending a free end of the bracket along a side of the stud and beyond the width of the stud and any wall covering placed over the near end of the stud.

41. The method as defined in claim 40, comprising the further steps of forming the bracket to have an L-shape, and securing a short leg of the bracket to the rear of the stud and securing a long leg of the bracket to the side of the stud.

42. The method as defined in claim 41, wherein the wall covering comprises drywall and comprising the further steps of forming a taper on the free end of the long leg and forcing that tapered end to penetrate through the drywall.

43. The method as defined in claim 40, comprising the further steps of securing a second bracket to a rear side of a second wall stud near a location where the water heater is to be anchored, extending a free end along a side of the second stud and beyond the width of the stud and any drywall placed over the stud.

44. The method as defined in claim 43, comprising the further steps of forming the first and second brackets to have an L-shape, and securing a short leg of the second bracket to the rear of the second stud and securing a long leg of the second bracket to the side of the second stud.

45. The method as defined in claim 44, comprising the further steps of forming a taper on the free end of the long leg of the brackets and forcing that tapered free end through a sheet of drywall.

46. The method as defined in claim 45, comprising the further steps of placing a water heater intermediate the first and second brackets and connecting the free ends of the first and second brackets to the strap to partially encircle and support the water heater.

47. The method as defined in claim 44, comprising the further steps of placing a water heater intermediate the first and second brackets and connecting the free ends of the first and second brackets to the strap to partially encircle and support the water heater.

48. The method as defined in claim 43, comprising the further steps of placing a water heater intermediate the first and second brackets and connecting the free ends of the first and second brackets to the strap to partially encircle and support the water heater.

49. A method for restraining a water heater by connecting the heater to support members in a wall, comprising the steps of fastening a first bracket to a rear side of a first support member and extending a distal end of the first bracket beyond the support member and through any intervening wall covering, fastening a second bracket to a rear side of a second support member and extending a distal end of the second bracket beyond the second support member and through any intervening wall covering, fastening a strap to the distal ends of the brackets, and locating the first and second support members so the strap at least partially encircles and supports the water heater.

50. The method of claim 49, comprising the further steps of forming the distal ends of the brackets to have a taper and forcing the tapered ends through the wall covering.

* * * * *